United States Patent [19]

Klein

[11] 4,037,185

[45] July 19, 1977

[54] GROUND FAULT CIRCUIT BREAKER WITH TRIP INDICATION

[75] Inventor: Keith W. Klein, Simsbury, Conn.

[73] Assignee: General Electric Company, New York, N.Y.

[21] Appl. No.: 665,904

[22] Filed: Mar. 11, 1976

[51] Int. Cl.[2] ..... H01H 83/02

[52] U.S. Cl. ..... 335/18; 335/17; 361/115

[58] Field of Search ..... 335/17, 18; 317/18 D

[56] References Cited

U.S. PATENT DOCUMENTS

| | | | |
|---|---|---|---|
| 3,970,975 | 7/1976 | Gryctko | 335/18 |
| B 340,170 | 3/1976 | Douglass et al. | 317/18 D |

*Primary Examiner*—Harold Broome

*Attorney, Agent, or Firm*—Robert A. Cahill; Walter C. Bernkopf; Frank L. Neuhauser

[57] ABSTRACT

A ground fault circuit interrupting (GFCI) device includes a conventional circuit breaker equipped with a trip mechanism operable automatically to open the breaker contacts in response to overcurrent conditions. A GFCI module, responsive to ground leakage current, actuates a trip solenoid to open the breaker contacts via the trip mechanism in response to a ground fault. An indicator, carried by linkage interconnecting the solenoid and trip mechanism, is moved into registry with an opening in the breaker case only upon actuation of the solenoid to thus indicate the occurrence of a ground fault trip function.

9 Claims, 5 Drawing Figures

GROUND FAULT CIRCUIT BREAKER WITH TRIP INDICATION

BACKGROUND OF THE INVENTION

Ground fault circuit interrupting (GFCI) devices have gained wide usage as a safety measure to prevent injurious electrical shock occasioned by ground faults. Electrical equipment manufacturers have found it possible to combine the ground fault interrupting capability with the overload and short circuit interrupting capability of conventional automatic electric circuit breakers in a molded case compatible in size with conventional circuit breakers so as to be acceptable in existing electrical service entry equipment. Consequently, GFCI circuit breakers can be conveniently installed in place of conventional circuit breakers to gain ground fault shock prevention without sacrificing the requisite elements of circuit protection.

A significant drawback engendered by combining the shock protective and circuit protective functions with a single circuit breaking mechanism is the inability to distinguish between which of the functions triggered the circuit breaking mechanism to interrupt the circuit. If, upon contact with an appliance, one experiences a momentary electrical shop as the GFCI circuit breaker trips, it is manifest that the shock perfective function was responsible for the circuit interruption. However, occasionally one will discover a dead circuit and find that the GFCI circuit breaker has tripped for no apparent reason. From a trouble-shooting standpoint, it would be most helpful to know whether the GFCI circuit breaker tripped because of an overcurrent condition or because of spurious ground leakage current caused, for example, by a breakdown of the electrical insulation of the wiring or the appliance connected thereto.

It is accordingly an object of the present invention to provide a circuit breaker having overcurrent and ground fault protective capabilities which includes means for indicating which of the protective capabilities was operative to initiate a trip function.

A further object of the present invention is to provide a GFCI circuit breaker of the above character, wherein the indicating means is selectively conditioned automatically incident to tripping of the circuit breaker.

Yet another object of the present invention is to provide a GFCI circuit breaker of the above character, wherein the indication manifested by the indicating means is sustained until the circuit breaker is manually reset.

A further object of the present invention is to provide a GFCI circuit breaker of the above character which is economical and compact in design and reliable in operation.

Other objects of the invention will in part be obvious and in part appear here and after.

SUMMARY OF THE INVENTION

In accordance with the present invention, there is provided a circuit interrupter or circuit breaker having an operating mechanism for moving a movable contact between a closed circuit position in engagement with a stationary contact and an open circuit position in spaced relation to the stationary contact. The circuit breaker of the present invention further includes a trip mechanism acting normally to sustain the operating mechanism in its condition where the breaker contacts are engaged and to release the operating mechanism to precipitate separation of the contacts automatically in response to abnormal circuit conditions. Typically, the trip mechanism will take the form of a thermal magnetic trip unit which includes a bi-metallic element adapted to trip the circuit breaker in response to overload conditions. Additionally, the trip mechanism will also typically include an electromagnetic unit effective to trip the circuit breaker instantaneously in response to a heavy overload or short circuit condition.

To afford ground fault detection, the circuit breaker of the present invention further includes a ground fault circuit interrupting module equipped to sense the existence of ground leakage current. When the ground leakage current reaches a predetermined magnitude, the module triggers an electronic switch to complete an energization circuit for a trip solenoid. The plunger of the trip solenoid is operatively linked to the trip mechanism so as to produce tripping of the circuit breaker in response to a ground fault condition.

A specific feature of the GFCI circuit breaker of the present invention is the inclusion of indicator means to indicate which of the protective functions, overcurrent or ground fault, had been operative to trip the circuit breaker. That is, the indicator means is adapted to indicate whether the trip unit operated in response to an overcurrent condition, overload or short circuit, to trip the circuit breaker, or the trip unit was operated by the trip solenoid to trip the circuit breaker in response to the ground fault condition sensed by the GFCI module.

More specifically, the indicator means of the present invention is in the form of a flag carried by linkage means operatively interconnecting the trip solenoid with the trip unit. The flag is positioned either in registry with or out of registry with a window formed in the circuit breaker case, depending upon whether or not the linkage was articulated by the trip solenoid to induce tripping of the circuit breaker. Additional detenting means, acting on the linkage, serves to sustain the flag in either of its two indicating positions once the circuit breaker has been tripped, thus to insure against any ambiguity as to which of the trip functions, overcurrent or ground fault, was responsible for tripping the breaker.

The invention accordingly comprises the features of construction, combination of elements, and arrangement of parts which will be exemplified in the construction hereinafter set forth, and the scope of the invention will be indicated in the claims.

For a fuller understanding of the nature and object of the invention, reference should be had in the following detailed description taken in connection with the accompanying drawing, in which.

Like reference numerals refer to corresponding parts throughout the several views of the drawing.

DETAILED DESCRIPTION

Figure 1:
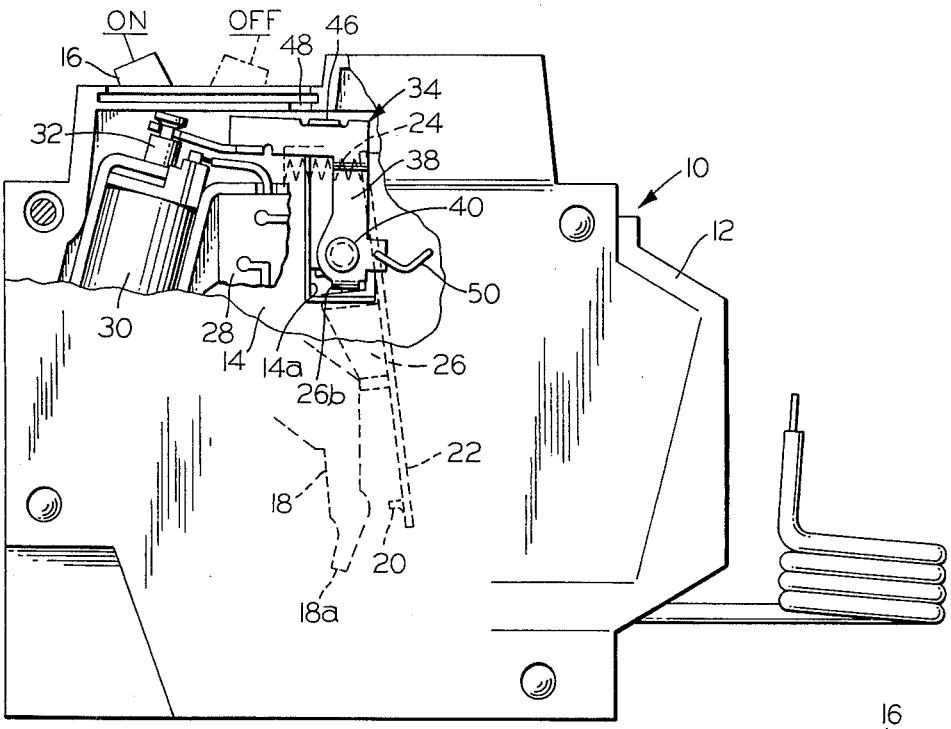
FIG. 1 is a side elevational view, partially broken away, of a GFCI circuit breaker utilizing trip indicating means in accordance with the invention, wherein the various parts are in the positions assumed upon execution of an overcurrent trip function.
Figure 2:
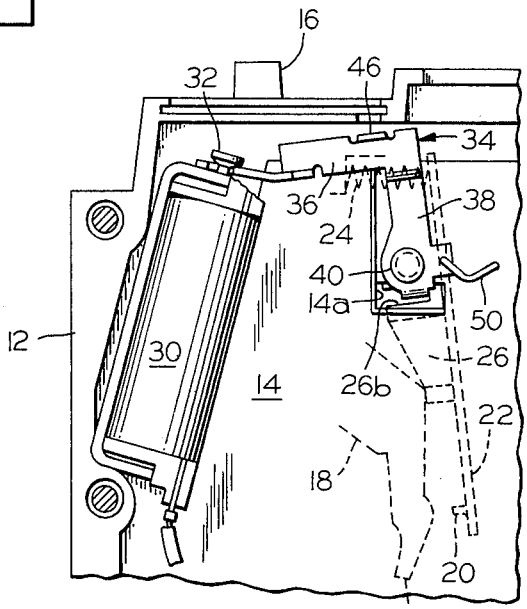
FIG. 2 is a fragmentary side elevational view of the circuit breaker of FIG. 1 illustrating the positions of the various parts assumed upon execution of a ground fault trip function.

Referring to the drawing, the present invention is illustrated in its implementation to a known ground fault circuit interrupting (GFCI) device, such as a GFCI circuit breaker as illustrated in applicant's U.S. Pat. No. 3,789.268. This circuit breaker, generally indicated at 10 in FIGS. 1 and 2, herein, includes a molded case 12 providing side-by-side compartments separated by an intermediate wall 14. The compartment to the opposite side of wall 14 from the reader accommodates the component parts of an automatic electric circuit breaker, which may be of known construction such as illustrated in U.S. Pat. No. 3,464,040. As seen in this patent, the disclosure of which is specifically incorporated herein by reference, an operating mechansim articulates a movable contact between positions of engaging and disengaging relation relative to a stationary contact, which positions are normally sustained by an over-center spring arrangement. Manual conditioning of the operating mechanism between contact engaging and disengaging conditions is facilitated by an externally accessible handle, seen at 16 in FIG. 1 herein. The operating mechanism also includes a pivotally mounted cradle, indicated at 18 in FIGS. 1 and 2 herein, which is normally held in an elevated position by engagement of its lower tip 18*a* with a latching tab 20 carried by a latching member 22 pivotally mounted adjacent its upper end in the circuit breaker compartment of case 12. A spring 24 acting on the upper end of latching member 22 urges latching tab 20 to the left, as seen in FIGS. 1 and 2 herein, and thus position the tab to intercept and latchably engage tip 18*a* of cradle 18 as the latter is elevated during manual resetting of the operating mechanism.

Latching member 22 is one component of a thermal-magnetic trip mechanism such as disclosed in the above-mentioned U.S. Pat. No. 3,464,040 and serves as the mechanical interface between the operating mechanism and the trip mechanism. Thus, the latch member serves as the armature for a magnetic field piece in which flux is developed in proportion to the current flowing in the circuit in which the circuit breaker is installed. Under heavy current overload or short circuit conditions, sufficient flux is developed in the field piece to attract the latching member and thus move latching tab 20 out of latching engagement with tip 18*a* of cradle 18. Release of the cradle abruptly alters the line of action of the mechanism spring such that the movable contact is disengaged from the stationary contact in quick-break fashion.

Tripping of the circuit breaker under less severe overcurrent conditions is achieved by an inverse-time element in the form of an elongated bi-metallic element included in the trip mechanism. As disclosed in U.S. Pat. No. 3,464,040, deflection of the bi-metal in response to a continuing overcurrent condition is communicated to latching member 22 by a hook, such that latching tab 20 releases cradle 18 and the circuit breaker is similarly tripped.

To accommodate external tripping of the circuit breaker, there is provided a so-called common trip latch actuating member, which is disclosed in U.S. Pat. No. 3,464,040 and illustrated herein at 26. This latch actuating member is provided with laterally extending ears 26*a* (FIG. 3) adjacent its upper end to facilitate its pivotal mounting in the circuit breaker compartment in closely spaced depending relation to latching member 22. To provide internal common tripping of plural circuit breakers ganged together in a multi-pole configuration, the latch actuating members of each breaker are tied together by a common trip bar, as is common practice. Thus, when the trip mechanism of one of the circuit breakers operates to initiate interruption of its circuit pole, the released cradle impacts against its associated latch actuating member, swinging it toward its latching member. Since all of the latch actuating members are tied together by the common trip bar, the other trip actuating member or members move in concert to trippingly engage their respective latching members. Thus, tripping one of circuit breaker results in tripping of the other circuit breaker or breakers included in the multi-pole configuration.

In the application of a known circuit breaker, such as generally described above, to a GFCI application, the compartment to the side of wall 14 nearest the reader is, as described in detail in the above-noted U.S. Pat. No. 3,789,268, fashioned to accommodate an electronic module and a trip solenoid, indicated respectively at 28 and 30 herein. The module 28 includes, as is well known in the art, a current sensor, typically a differential current transformer, designed to sense an imbalance in the currents following in the line and neutral sides of the distribution circuit to which the GFCI circuit breaker 10 is applied. Such current imbalances signify the fact that leakage current is returning to the source via a ground fault and an un-intended ground path. When the magnitude of ground leakage current reaches hazardous proportions, the module triggers an electronic switch to complete an energization circuit for trip solenoid 30. Energization of the solenoid attracts its plunger 32 downward; this movement of the plunger being communicated through wall 14 into the circuit breaker compartment by linkage generally indicated at 34. Latch actuating member 26 is pivoted by linkage 34 into tripping engagement with latching member 22, thus initiating circuit interruption in response to a hazardous ground fault condition.

Figure 3:
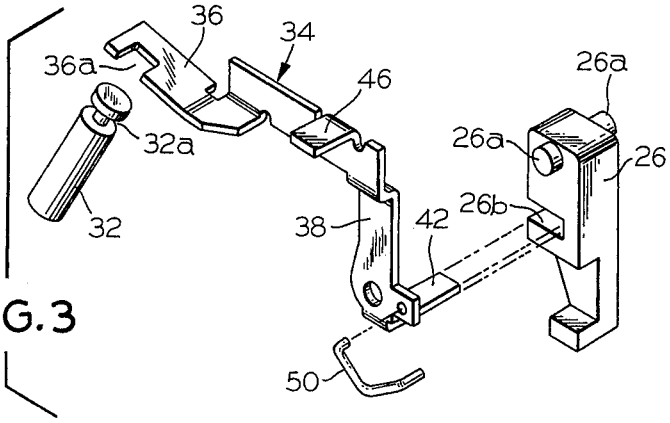
FIG. 3 is an exploded perspective view of the parts of the trip indicating means of FIGS. 1 and 2.

Linkage 34, as seen in FIGS. 1 – 3 herein, is generally L-shaped, having a horizontally extending arm 36 and a vertically depending arm 38. The linkage is pivotally mounted to intermediate wall 14 adjacent the lower end of arm 38 by a rivet 40. The upper end of solenoid plunger 32 is provided with an annular groove 32*a* which is received in a laterally opening notch 36*a* (best seen in FIG. 3) formed in the terminal portion of arm 36. The terminal portion of arm 38 carries a laterally turned actuating tab 42 which extends into the circuit breaker compartment through an opening 14*a* (FIGS. 1 and 2) in wall 14 for receipt in an open-ended notch 26*b* formed in latch actuating member 26. From the description thus far, it is seen that when plunger 32 is pulled down by energization of trip solenoid 30, linkage 34 is pivoted in the counter-clockwise direction, causing actuating tab 42 to engage the end wall of notch 26*b* in latch actuating member 26. The latch actuating member is thus likewise pivoted counter-clockwise into tripping engagement with latching member 22.

Figure 4:
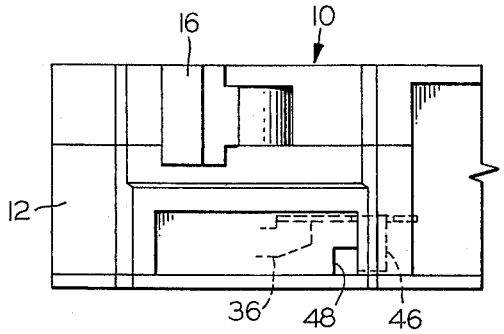
FIG. 4 is a fragmentary plan view of the circuit breaker in its condition illustrated in FIG. 1.
Figure 5:
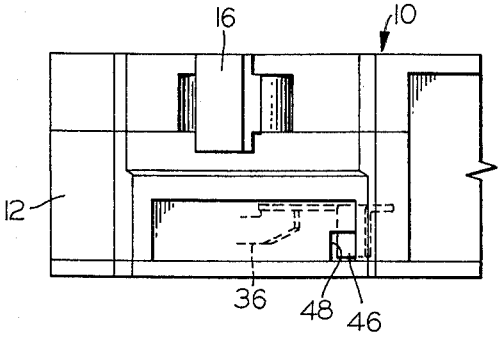
FIG. 5 is a fragmentary plan view of the circuit breaker in its condition illustrated in FIG. 2.

In accordance with the present invention, indicating means is selectively positioned under the control of linkage 34 to one of two indicating positions and thus signify whether the circuit breaker was tripped by operation of its trip mechanism in response to an abnormal overcurrent condition or by operation of the trip solenoid in response to a ground fault condition sensed by module 28. In the disclosed embodiment, the indicating means takes the form of a flag 46 carried by linkage arm 36 adjacent its junction with linkage arm 38. Normally the flag, which may be distinctly colored, is positioned out of registry with a window 48 provided in the molded case 12 and thus is not observable therethrough. This non-display indicating position of flag 46 prevails as long as plunger 32 remains in its elevated position shown in FIG. 1. It is noted that this non-display position of flag 46 is not disturbed when the circuit breaker is tripped on an abnormal overcurrent condition by its trip unit. This is seen from the fact that counter-clockwise pivotal movement of latch actuating member 26 upon impact by cradle 18 incident to separation of the breaker contacts by the operating mechanism does not disturb linkage 34 since left end of notch **26*b* is open. Thus engagement of linkage actuating tab 42 by latch actuating member 26 is avoided as the latter is pivoted by the impact of cradle 18. On the other hand, when the linkage 34 is articulated by retraction or downward movement of the trip solenoid plunger, flag 46 is moved to its display position in registry with window 48 while actuating tab 42 pivots latch actuating member 26 into tripping engagement with latching member 22. Consequently, to determine whether circuit breaker 10 tripped because of an abnormal overcurrent condition or because of a ground fault, one simply looks in window 48. If flag 46 is observable in the window (FIGS. 2 and 5), one knows a ground fault condition was responsible. Conversely, if the flag is not viewable in the window (FIGS. 1 and 4**), one deduces that an abnormal current condition was responsible.

While not considered essential, it is preferable to provide some manner of detent means to render the two indicating positions of flag 46 reasonably stable against minor shock and also breaker orientation. This is particularly so since, in practice, the trip solenoid 30 is energized only briefly in initiating a ground fault trip function and thus there is no continuing attractive force holding the plunger down to sustain flag 46 in registry with window 48. Similarly, a separate spring biasing plunger 32 to its elevated position is not contemplated, and thus there is no inherent force sustaining the non-viewable indicating position of flag 46 while the circuit breaker is in its tripped condition. In practice, spring 24 is utilized not only to return latching member 22 to its quiescent, cradle latched position, but to return latch actuating member 26, linkage 34 and plunger 32 to their quiescent positions as well.

Suitable detent means stabilizing the two indicating positions of flag 46 is provided in the illustrated embodiment by a simple compression spring 50 having its one end hooked in a hole provided in the lower end of arm 38 and its other end hooked in a hole provided in intermediate wall 41. The locations of the ends of spring 50 relative to the pivot axis of linkage 34 provided by rivet 40 are selected such that the spring, in attempting to assume a more straightened configuration, exerts a clockwise torque on the linkage while in its orientation shown in FIG. 1 and a counter-clockwise torque on the linkage in its orientation shown in FIG. 2. The torque exerted by spring 50 need not be large, and this is readily overcome by the trip solenoid in initiating a ground fault trip function and by the latching member spring 24 in acting to return the linkage and plunger to their quiescent positions during manual resetting of the circuit breaker following a ground fault trip function.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

Having described my invention, what I claim as new and desire to secure by Letters Patent is:

1. A circuit interrupting device comprising, in combination:

A a molded case;

B. a trip unit disposed within said case and operative in response to an overcurrent condition to initiate interruption of a circuit protected by the device;

C. an electronic module positioned within said case and sensitive to ground leakage current occasioned by a ground fault on the circuit;

D. a trip solenoid position within said case and electrically connected for energization under the control of said module in the event of a ground fault;

E. linkage interconnecting said solenoid and said trip unit, said linkage articulated by said solenoid upon energization thereof to induce operation of said trip unit to initiate circuit interruption;

F. mechanical trip indicator means movable between first and second indicating positions under the control of said trip solenoid, whereby to indicate by virtue of its position following a circuit interruption whether an overcurrent condition or a ground fault condition was responsible; and G. detent means acting on said trip indicator means to releasably sustain said trip indicator means in the one of its first and second indicating positions assumed under the control of said trip solenoid following a circuit interruption.

2. The circuit interrupting device defined in claim 1, which further includes means forming a window in said case, the second indicating position of said indicator means being in registry with said window.

3. The circuit interrupting device defined in claim 2, wherein said indicator means is in the form of a flag movable with said linkage.

4. The circuit interrupting device defined in claim 3, wherein said flag is carried by said linkage.

5. The circuit interrupting device defined in claim 4, wherein said linkage is pivotally mounted within said case.

6. The circuit interrupting device defined in claim 5, wherein said linkage is L-shaped having a first arm operatively coupled adjacent its end to said trip solenoid and a second arm operatively coupled adjacent its end to said trip unit.

7. The circuit interrupting device defined in claim 6, wherein said indicator means is in the form of a flag carried by said first arm at a location adjacent its junction with said second arm.

8. The circuit interrupting device defined in claim 7, wherein said detent means is in the form of a spring acting on said linkage to detain said flag in either of its first and second indicating positions.

9. The circuit interrupting device defined in claim 8, which further includes means forming a window in said case, the second indicating position of said flag being in registry with said window.

* * * * *